US005450972A

United States Patent [19]

Zemlo

[11] Patent Number: 5,450,972

[45] Date of Patent: Sep. 19, 1995

[54] TAMPER-EVIDENT BAND FOR CLOSURES

[75] Inventor: Bridgett E. Zemlo, West Chicago, Ill.

[73] Assignee: Phoenix Closures, Inc., Naperville, Ill.

[21] Appl. No.: 205,323

[22] Filed: Mar. 3, 1994

[51] Int. Cl.[6] ..... B65D 41/34; B65D 41/47

[52] U.S. Cl. ..... 215/252; 215/318

[58] Field of Search ..... 215/250, 252, 254, 256, 215/318

[56] References Cited

U.S. PATENT DOCUMENTS

| | | | |
|---|---|---|---|
| 2,162,712 | 6/1939 | Hamberger | 215/252 |
| 3,980,195 | 9/1976 | Fillmore . | |
| 4,147,268 | 4/1979 | Patel et al. . | |
| 4,156,490 | 5/1979 | Peraboni . | |
| 4,278,180 | 7/1981 | Willis . | |
| 4,333,577 | 6/1982 | Mumford . | |
| 4,387,818 | 6/1983 | Conti . | |
| 4,418,828 | 12/1983 | Wilde et al. . | |
| 4,432,461 | 2/1984 | Mumford et al. . | |
| 4,436,212 | 3/1984 | Llera . | |
| 4,448,318 | 5/1984 | Lowe | 215/252 |
| 4,497,765 | 2/1985 | Wilde et al. . | |
| 4,506,795 | 3/1985 | Herr . | |
| 4,530,437 | 7/1985 | Gray et al. . | |
| 4,530,438 | 7/1985 | McDevitt . | |
| 4,549,667 | 10/1985 | Dullabaun . | |
| 4,550,844 | 11/1985 | Lininger . | |
| 4,567,993 | 2/1986 | Albrecht et al. . | |
| 4,579,241 | 4/1986 | Hayes . | |
| 4,595,110 | 6/1986 | Herr . | |
| 4,609,115 | 9/1986 | Moore et al. . | |
| 4,666,053 | 5/1987 | Corcoran et al. . | |
| 4,679,696 | 7/1987 | Bonnenfant et al. . | |
| 4,700,859 | 10/1987 | Gregory . | |
| 4,720,018 | 1/1988 | Schetzsle et al. . | |
| 4,756,438 | 7/1988 | Ryder . | |
| 4,768,666 | 9/1988 | Kessler . | |
| 4,807,771 | 2/1989 | Roy et al. . | |
| 4,846,361 | 7/1989 | Haffner . | |
| 4,899,898 | 2/1990 | Thompson . | |
| 4,913,299 | 4/1990 | Petro . | |
| 4,919,285 | 4/1990 | Roof et al. . | |
| 4,923,073 | 5/1990 | Wilde . | |
| 4,978,016 | 12/1990 | Hayes . | |
| 5,135,123 | 8/1992 | Nairn et al. . | |
| 5,137,163 | 8/1992 | Moore . | |
| 5,271,512 | 12/1993 | Ekkert | 215/252 |
| 5,314,085 | 5/1994 | Bonet | 215/252 |

FOREIGN PATENT DOCUMENTS

| | | |
|---|---|---|
| 7422601 | 1/1976 | France . |
| 2314864 | 10/1974 | Germany . |
| 3144924 | 5/1983 | Germany . |

*Primary Examiner*—Allan N. Shoap
*Assistant Examiner*—Nathan J. Newhouse
*Attorney, Agent, or Firm*—Welsh & Katz, Ltd.

[57] ABSTRACT

A tamper evident closure assembly comprising a container, a cap and a band portion. The container has a neck with threads and an annular interference ring located axially below the threads and integral with the container finish. An annular tamper indicating band is detachably connected to the skirt of the cap with a plurality of spaced connectors located between the cap and the band. The band has an annular shoulder formed on the inside surface thereof. The interference ring includes at least one integral lug formed on its upper surface. The lug is configured with a downwardly sloping upper surface and a substantially vertical face. The sloping upper surface of the lug facilitates the application of the closure, and specifically the band, over the interference ring. The face of the lug forms a strengthening support against which the annular shoulder of the band rests.

16 Claims, 1 Drawing Sheet

FIG. 1
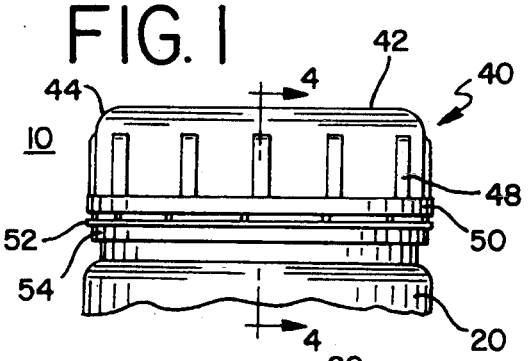
FIG. 2
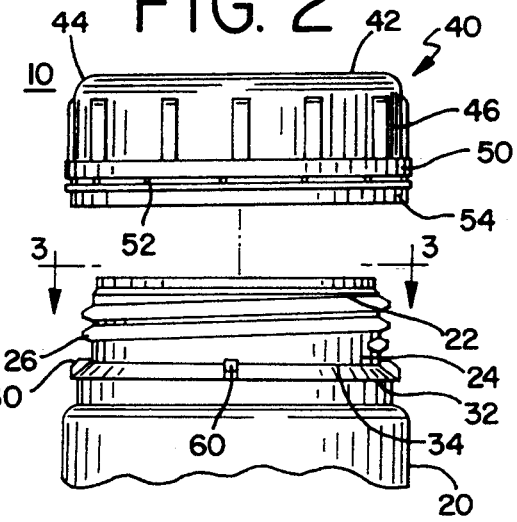
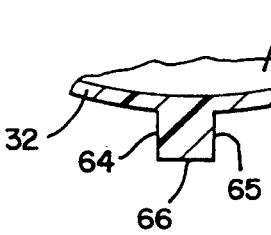
FIG. 6
FIG. 5
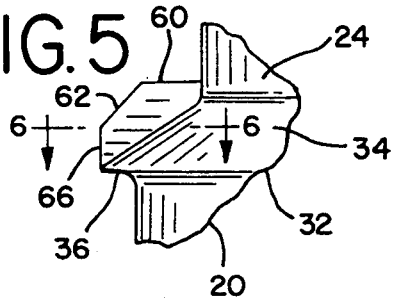
FIG. 3
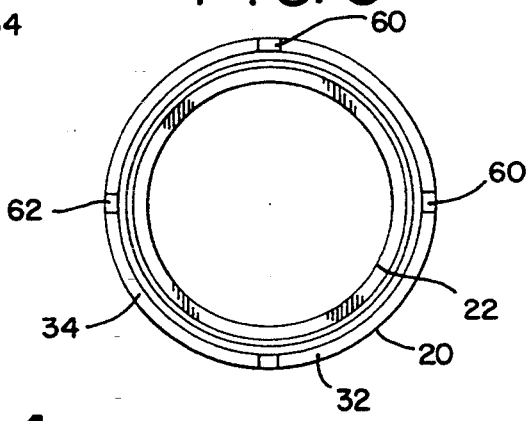
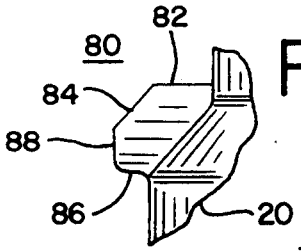
FIG. 7
FIG. 4
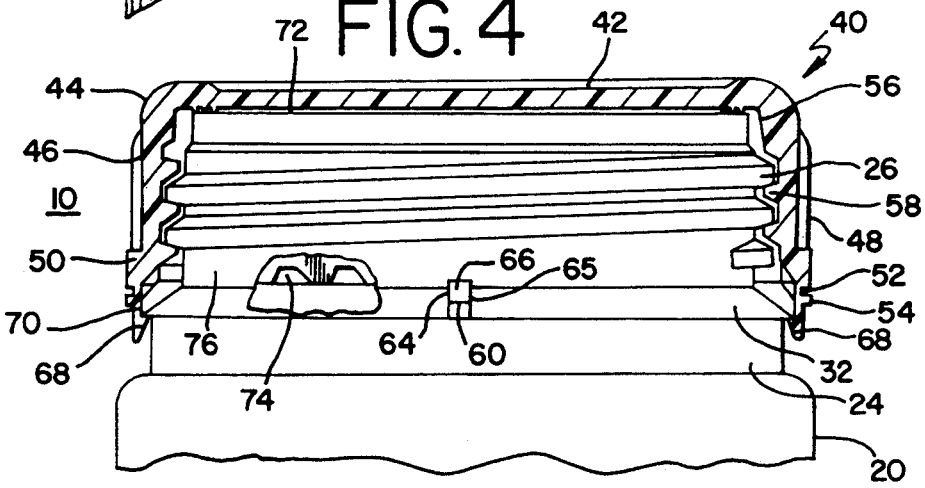

TAMPER-EVIDENT BAND FOR CLOSURES

The present invention relates to a tamper-evident closure for containers and, more specifically, to a tamper-evident closure assembly having an improved lug design on the container finish for facilitating application of the closure to the container.

BACKGROUND OF THE INVENTION

Typically, tamper-evident or tamper indicating closure assemblies incorporate a cap portion and a band portion. The band is connected to the cap with a plurality of frangible bridges, or weakened tabs, that break when attempts are made to remove the cap portion. Upon removal of the cap the band becomes separated from the cap and remains on the container's neck. The broken bridges and separated band provide the user with evidence that the container has already been opened and that the container contents may have been tampered with or altered.

Various designs are currently employed to effectuate the separation of the cap and band portions upon removal of the cap from the container. These designs typically utilize variations of a locking assembly whereby the band portion engages indentations, or notches and the like below the threading on the neck of the container to break the connectors and thereby separate the band when the cap is attempted to be removed. Similarly, there are currently a number of closure caps that utilize a camming means having an abutment or other contact point on the container surface which engages a bead-like formation integrally formed on the inside of the band portion causing the connectors to break, leaving the band separated from the cap.

The currently known tamper-evident closure designs sufficiently accomplish their intended purpose, that is, to provide the user with evidence of container tampering. However, the currently available tamper-evident designs are problematic in that it is difficult to apply the closure having an integral break-away band onto the container. The notches or bead-like formation on the container finish, which are essential for accomplishing the break-away action, protrude from the container finish and thereby create a barrier over which the break-away band must be forced during application of the closure to the container.

The obstruction that is created by the protrusions is a fundamental design dilemma since one can not simply eliminate the protrusions while maintaining the break-away action needed to separate the band from the closure. Accordingly, what can occur is that, during the application of the closure to the container, the break-away band may inadvertently separate from the closure, become deformed or damaged and lose its tamper indicating function it was intended to perform. The problems associated with the currently available tamper-evident assemblies create increased costs for container manufacturers, bottlers and the product companies, which costs are eventually passed on to the consumer.

Currently known tamper-evident closure assemblies also do not provide any strengthening support to the break-away band once it is successfully applied to the container. Thus, even if the closure assembly is not ruined during the application process, the band may separate or distort during shipping and handling.

SUMMARY OF THE INVENTION

Accordingly, a principal object of the present invention is to provide a tamper-evident closure assembly which facilitates the application of the assembly to the container.

Another object of the present invention is to provide a tamper-evident closure assembly which can be readily applied to a container without inadvertent breakage of the break-away band.

Yet another object of the present invention is to provide a tamper-evident closure that includes a lug and ring arrangement integral to the container finish which facilitates application of the closure to the container while also providing increased support for the break-away band once the closure is correctly applied to the container.

In accordance with the present invention, these objectives, as well as others not herein specifically identified, are achieved generally by the present tamper evident closure with an angled lug design. The closure assembly generally comprises a typical upper cap portion connected to a lower band portion by breakable connectors that form a weakened line between the cap and band portions. The cap portion has internal threads that engage the complimentary threaded finish of the container's neck. When it is desired to remove the closure for the first time, the unthreading of the closure by the user causes the closure to move away from the container, while the bead acts as an interference contact surface causing the break-away band to separate from the closure.

In the preferred embodiment, the upper surface of the interference ring formed on the container finish includes a plurality of spaced-apart lugs. The lugs are angled downwardly and away from the container finish such that a break-away bead formed on the inside surface of the break-away closure band can slide over the container bead during initial application of the closure to the container. Once the closure is applied to the container, the front surface or face of the container lugs provide strengthening support to the break-away band.

In an alternative embodiment, the container's interference ring is replaced with a plurality of angled container lugs that serve a dual function. First, the upper surface of the lugs are configured with a downwardly angled slope to facilitate the application of the closure assembly, namely the break-away band, over the container lugs to the container. Second, the lower surface of the container lugs are configured to act as the interference contact surface that causes the break-away band to separate from the closure during initial removal of the closure.

DETAILED DESCRIPTION OF THE DRAWINGS

Additional advantages and features of the present invention will become apparent from the following detailed description and claims when viewed in connection with the accompanying drawings in which:

FIG. 1 is a frontal view of the present tamper-evident closure of the present invention shown applied to a container;

FIG. 2 is a frontal view of the present tamper-evident closure of FIG. 1 shown exploded from the container mouth;

FIG. 3 is a top view of the present tamper-evident closure assembly of FIG. 2 showing the lugs on the container neck taken along lines 3—3;

FIG. 4 is an frontal view of the present tamper-evident closure assembly of the present invention showing the dual functionality of the lugs and the lug pockets in phantom;

FIG. 5 is a detailed side view of the present container showing the lug taken along lines 6—6 of FIG. 6;

FIG. 6 is a detailed top view of the present container showing the lug; and

FIG. 7 is a detailed side view of an alternative embodiment of the container lug.

DETAILED DESCRIPTION OF THE INVENTION

Referring more particularly to the drawings, FIGS. 1 and 2, the invention is generally referred to as the closure assembly 10. In FIG. 2, the container 20 is shown exploded from the closure cap 40 of the present invention. The container 20 includes a mouth portion 22 and an integral neck portion 24 having molded integrally thereon external threads 26. The container 20 may be a typical blow molded plastic container, or the present invention will work equally as well with containers made of other materials such as glass and the like.

The container neck 24 has integrally formed thereon an annular interference bead or ring 32 which is positioned axially below the threads 26. Interference ring 32 has an upper surface 34 and a lower surface 36. The interference ring 32 will typically be a continuously formed ring that encircles the neck 24 of the container 20. It is contemplated that the interference ring 32 may not fully encircle the neck 24 or can be configured as a plurality of disjointed portions that fully or partially encircle the neck 24. It is important to realize that the interference ring 32 must have sufficient surface area to provide the required contact with the given break-away band to effectuate separation thereof from the closure 10.

It is contemplated that the inventive closure 10 will be used with a typical closure cap 40, such as that shown in FIGS. 2 and 4, which comprises a top, or more specifically, a top closure panel 42, a peripheral edge 44 and an annular skirt or side wall 46 integrally depending from the peripheral edge 44. Annular skirt 46 can incorporate a knurled finish or grip enhancers 48. The grip enhancers 48 are shown as nodules protruding from the skirt 46, and may be vertical and equally spaced, or angled, horizontal, and variably spaced. The skirt 46 has at its lower end, opposite the top 42, an outwardly extending annular lip 50, which extends around the circumference or periphery of the skirt 46. Depending from annular lip 50 are breakable connectors, or bridges 52, which are plastic tabs that can be of a softened plastic as compared to the plastic used for the cap portion 40. Connected to the lower end of the breakable connectors 52 is a severable tamper indicating, or break-away band 54.

The inside surface 56 of the skirt 46 incorporates internal threads 58 which are configured to engage the external threads 26 on the container neck 24 during application or removal of the cap 40. Upon application of the closure 10 to the container 20, such as by threading the closure 10 down onto the container 20, the break-away band 54 is forced down below the interference ring 32.

As shown most clearly in FIGS. 2–6, the inventive feature of the present closure 10 is the unique configuration of the interference ring 32 formed on the container 20. More specifically, the ring 32 includes on its upper surface 34 at least one, and preferably a plurality, of container lugs 60. Preferably, the container lugs 60 are integrally formed with the interference ring 32. The lugs 60 include at least a ramped surface 62, sides 64 and 65 and a face 66. Shown most clearly in FIG. 5, in the preferred embodiment of the invention, the ramped surface 62 of the lugs 60 is angled downwards and away from the container neck 24 at a slope of approximately 50 degrees. Although a 50 degree slope has been found to be most effective, other angles may work equally as well depending on the application of the present invention. It has been found that for most container types four to six lugs 60 are sufficient to accomplish their intended tasks.

More specifically, the configuration of the surface 62 of the container lugs 60 provide an "on-ramp" for facilitating the application of the closure 10 having a break-away band 54 to a container 20. As shown in FIG. 4, the break-away band 54 will typically include on its inside surface 70 an inwardly, radially projecting ridge or bead 68, which is used in conjunction with the interference ring 32 on the container finish to cause the break-away band 54 to separate from the cap 40. During application of the closure 10 to the container 20, the bead 68 is forced below the lower surface of the interference ring 32. It is contemplated that a conventional capping method will be used to initially engage the closure 10 to the container 20. Thus, the method would comprise screwing the cap 40 onto the container 20 whereby the closure threads 26 engage the container threads 58 while the band 54 with the bead 68 slides down and over the lugs 60 and consequently the interference ring 32.

When it is desired by the user to access the product held in the container 20, the user grasps the cap 40 and twists it off. As the user applies twisting torque to remove the container cap portion 40, the bead 68, located on the inside of the band 54, contacts with the lower surface 36 of the interference ring 32 causing the band 54 to pull away from the cap portion 40 and break the bridges 52 sequentially or one or more at a time. Thus, a vertical tearing or severing force is exerted on each of the bridges 52 as the cap 40 is driven up from the container neck 24. This tearing force is a result of cap 40 being forced upwards relative to the bead 68 due to the threading 26 and 58, while the band 54 is obstructed from upward movement due to the contact between the interference ring 32 and the bead 68. The vertical tearing or severing force will typically be in an axially vertical direction in relation to the cap 40 and the band 54.

It should be understood that the bead 68 need not be continuous, but rather can be formed as a series of independent steps, lugs or protrusions. It is also contemplated that conventional annular sealing beads or sealing rings may be incorporated into the upper surface 72 of the cap 40 to effectuate a leak proof seal between the cap 40 and the container 20.

Furthermore, it should be understood that the configuration of the interference ring 32 and the bead 68, together with the threading 26 and 58, will cause the cap 40 to fit more securely onto the container 20 by forcing the cap 40 axially downwards towards the container 20 prior to removal of the closure 10. This downward locking of the cap 40 will be found to help prevent backing off that normally occurs during shipping and handling of a filled container 20.

During ordinary shipping and handling of the container 20 having a closure, such as closure 10, bumping, bouncing and other movements, as well as container pressure can cause the band 54 to break prematurely or become deformed. During design and testing of the present closure 10, it was discovered that the configuration of the lugs 60 of the present invention can be useful in minimizing these problems. The lugs 60 can perform a useful secondary function by creating a surface against which the band 54 or the bead 68 abuts against once the closure 10 is applied to the container 20. More specifically, as shown best in FIG. 4, the face 66 of the lugs 60 abut against the inside surface 70 of the band 54 and thereby creates a supporting buttress against which the band 54 can rest and not be forced against the container 20. By limiting the movement of the band 54, the lugs 60 help to prevent premature breakage of the bridges 52 during shipping and handling. To this end, it is preferred that the face 66 of the lugs 60 be substantially flat, vertical and parallel in relation to the container neck 24.

Also, as shown in FIG. 4, the present closure can optionally include a plurality of lug pockets 74 (shown in phantom), which are dimensioned to receive a complimentary lug 60 once the closure is applied onto the container 20. The lug pockets 74 are formed along the lower edge 76 of the inside surface 70 of the skirt 46. The lug pockets 74 essentially retain the lugs 60 which prevents the lugs 60 from any substantial axial movement to help minimize backing off of the cap 40. If the optional lug pockets 74 are used, then it is important to realize that the height of the lugs 60, and therefore, the degree of slope of the ramped surface 62, must be chosen so that the lugs 60 are of a sufficient height to be retained within the lug pockets 74. If the lugs 60 are angled too steeply or are not high enough they will be ineffective in preventing back-off since the lug pockets 74 will not be able to catch and retain the lugs 60. It is contemplated that for some applications such a lug design that does not catch within the lug pockets 74 may be desirable.

The alternative embodiment, as depicted in FIG. 7, is generally referred to as the closure assembly 80. Essentially, the alternative embodiment comprises the same elements as the preferred embodiment. However, unlike the preferred embodiment, here the container lugs 82 are configured to replace the need for an interference ring, such as ring 32. The container lugs 82 actually perform two primary functions in the alternative embodiment. First, they facilitate the application of the closure 80 onto the container 20 since the alternative container lugs 82 also utilize the inventive sloping or ramped surface 84. Again, as in the preferred embodiment, the angle of this slope will generally be in the neighborhood of approximately 50 degrees.

Second, the lugs 82 function, as does the interference ring 32, to provide a surface, the underside 86 of the lugs 82, that retains the bead 68 of the band 54 on the container 20 during initial unthreading or removal of the cap 40. Because of the interference or obstruction between the bead 68 and underside 86 of the lugs 82, the bridges 52 break allowing the cap 40 to be removed while leaving the separated band 54 on the container 20 as evidence of removal or attempted removal of the cap 40. If the lugs 82 are used as an interference structure it may be desirable to include more than four lugs 82 so as to provide sufficient underside 86 surface area to effectuate the necessary interference against the bead 68 to break the bridges 52.

It is contemplated that the lugs 82 of the alternative embodiment 80 can be configured and arranged on the container neck 24 to provide the support structure for the band 54 as described above in the preferred embodiment. Again, if the lugs 82 will be used to provide strength to the band 54, then the face 88 of the lugs 82 must be configured and arranged to abut against the bead 68.

The present closure 10 or 80, and particularly the lugs 60 or 82, provides an inexpensive way to eliminate the problems associated with currently available tamper-evident closure assemblies. The ramped lug configuration permits the application of the closure assembly 10 or 80 to a container 20 without damaging or causing the premature separation of the band 54 from the cap 40. Further, the lug design of the present invention provides strengthening support to the band 54, helps to prevent back-off and can be configured to act as the interference bead for a given container 20. Because the band 54 is far less likely to be broken or otherwise damaged or deformed, less of the end-product will be rejected by the seller or purchaser of the product based on what appears to be tampering, but what is actually a manufacturing or shipping and handling problem that does not necessarily affect the product.

While a particular embodiment and an alternative embodiment of the tamper evident closure of the invention has been shown and described, it will be appreciated by those skilled in the art that changes and modifications may be made thereto without departing from the invention in its broader aspects and as set forth in the following claims.

What is claimed is:

1. A tamper evident closure assembly comprising: a container having a neck having threads integrally formed thereon, said neck further having an integrally formed annular interference ring located axially under said threads;

said interference ring having on an upper surface thereof at least one lug, said lug having a downward sloping upper surface, a substantially flat vertical outer face, and substantially flat left side and right side surfaces, said side surfaces having planes extending substantially perpendicularly from said interference ring;

a cap having a top, a peripheral edge integral with said top and an annular skirt integrally depending from said peripheral edge;

said skirt having internal threads integrally formed for engagement with said threads on said container neck;

an annular tamper indicating band detachably connected to said skirt with a plurality of spaced bridges between said cap and said band;

said band having an annular shoulder on an inside surface thereof;

said sloping upper surface of said lug facilitating the application of said band by acting as a ramp upon which said annular shoulder can slide down and over said interference ring, and said face of said lug providing a support backing structure to said band once said cap is applied to said container; and said annular shoulder of said band and said interference ring configured and arranged relative to each other so that upon the application of twisting torque by the user to remove said cap from said container said bridges are subjected to a vertical force, which severs said bridges, thereby leaving said band on said neck of said container as evidence of tampering or removal.

2. A closure as described in claim 1 wherein said lug is integral with said interference ring.

3. A closure as described in claim 1 wherein said annular skirt has formed along its lower end at least one lug pocket configured and arranged to catch and retain said lug to prevent backing off of said cap.

4. A closure as described in claim 1 wherein at least four lugs are located equidistant on said interference ring.

5. A closure as described in claim 1 wherein said bridges are circumferentially and equally spaced weakened tabs.

6. A closure as described in claim 1 wherein said annular shoulder is a series of independent ridges formed around the radius of said band.

7. A tamper evident closure assembly comprising:

a container having a neck with threads thereon, said container neck having at least one lug located thereon, said lug located axially below said threads and having a sloping upper surface and a substantially horizontal underside, said lug having substantially flat left and right side surfaces, said side surfaces having planes extending substantially perpendicularly from said container neck;

a cap having a top, a peripheral edge integral with said top and an annular skirt integrally depending from said peripheral edge;

said skirt having internal threads integrally formed thereon to engage with said threads on said container neck;

an annular tamper indicating band detachably connected to said skirt with a plurality of spaced bridges between said cap and said band;

said band having an annular shoulder on an inside surface thereof;

said underside of said lug abutting against said annular shoulder of said band, thereby retaining said band on said container neck when said cap is initially removed from said container; and said sloping upper surface of said lug facilitates the application of said band by acting as a ramp upon which said annular shoulder can slide down and over said lug.

8. A closure as described in claim 7 wherein said lug is integrally formed on said container neck.

9. A closure as described in claim 7 wherein said face of said lug provides a support backing structure to said band once the closure is applied to said container, said face being substantially flat and parallel with respect to the container neck.

10. A closure as described in claim 7 wherein said annular shoulder is a series of independent ridges formed around the radius of said band.

11. A tamper evident closure assembly comprising:

a container having a neck having threads integrally formed thereon, said neck further having an integrally formed annular interference ring located axially under said threads;

said interference ring having on an upper surface thereof at least one lug, said lug having a downward sloping upper surface, a substantially flat vertical outer face, and substantially flat left side and right side surfaces, said side surfaces having planes extending substantially perpendicularly from said interference ring;

a cap having a top, a peripheral edge integral with said top and an annular skirt integrally depending from said peripheral edge;

said skirt having internal threads integrally formed for engagement with said threads on said container neck;

an annular tamper indicating band detachably connected to said skirt with a plurality of spaced bridges between said cap and said band;

said band having an annular shoulder on an inside surface thereof;

said annular shoulder of said band and said interference ring configured and arranged relative to each other so that upon the application of twisting torque by the user to remove said cap from said container said bridges are subject to a vertical force, which severs said bridges, thereby leaving said band on said neck of said container as evidence of tampering or removal; and said sloping upper surface having an angle of approximately 50 degrees to facilitate the application of said band by acting as a ramp upon which said annular shoulder can slide down and over said interference ring, and wherein said face of said lug provides a support backing structure to said band once the closure is applied to said container.

12. The closure as described in claim 11 wherein said lug is integral with said interference ring.

13. The closure as described in claim 11 wherein said annular skin has formed along its lower end at least one lug pocket configured and arranged to catch and retain said lug to prevent backing off of said cap.

14. A closure as described in claim 11 wherein at least four lugs are located equidistant on said interference ring.

15. A closure as described in claim 11 wherein said bridges are circumferentially and equally spaced weakened tabs.

16. A closure as described in claim 11 wherein said annular shoulder is a series of independent ridges formed around the radius of said band.

* * * * *